United States Patent [19]

Lumbroso et al.

[11] Patent Number: 4,828,651

[45] Date of Patent: May 9, 1989

[54] DECOKING PROCESS AND DEVICE

[75] Inventors: Daniel Lumbroso; Andrien Orieux, both of Rueil-Malmaison; Michel Davidson, Le Vesinet, all of France

[73] Assignee: Institut Francais du Petrole, Rueil-Malmaison, France

[21] Appl. No.: 149,023

[22] Filed: Jan. 27, 1988

[30] Foreign Application Priority Data

Oct. 29, 1987 [FR] France ..... 87 15141

[51] Int. Cl.[4] ..... C10B 33/00

[52] U.S. Cl. ..... 201/2; 134/22.18; 134/24; 134/39; 134/167 R; 202/241

[58] Field of Search ..... 201/2; 202/241; 134/22.18, 24, 34, 39, 167 R

[56] References Cited

U.S. PATENT DOCUMENTS

| | | | |
|---|---|---|---|
| 2,245,554 | 6/1941 | Court | 134/39 |
| 2,254,848 | 9/1941 | Holveck | 134/24 |
| 3,985,572 | 10/1976 | Petermann et al. | 134/34 |
| 4,107,001 | 8/1978 | Kinzler | 202/241 |
| 4,611,613 | 9/1986 | Kaplan | 202/241 |
| 4,626,320 | 12/1986 | Alworth et al. | 201/2 |

FOREIGN PATENT DOCUMENTS

| | | | |
|---|---|---|---|
| 2840441 | 3/1980 | Fed. Rep. of Germany . | |
| 376431 | 8/1973 | U.S.S.R. | 202/241 |

*Primary Examiner*—Joye Woodard

*Attorney, Agent, or Firm*—Millen & White

[57] ABSTRACT

Process for the removal of coke from a coking reactor of a series of coking reactors, comprising the projection of water under pressure at the coke via a water-ejection device hanging from a flexible tube guided by a guide pulley movably mounted above the reactors for translation between each reactor of the series of reactors.

9 Claims, 2 Drawing Sheets

DECOKING PROCESS AND DEVICE

BACKGROUND OF THE INVENTION

Our invention pertains to a coking process of hydrocarbon feedstocks, heavy distillation products or residues. More particularly, it pertains to the subsequent coke recuperation stage (decoking) following laydown within the reactor.

Coking is a well-known process in the refining industry, the objective of which is to upgrade heavy fractions and, more especially, the distillation residues by subjecting them to heat decomposition.

This usually occurs in large empty reactors where decomposition takes place in the form of distillates, which are removed from the reactor, and a coke deposit which gradually accumulates within the reactor.

The feedstock is usually introduced via the bottom of the reactor and, this being the case, coke is initially deposited in the lower part of the reactor, whence it progressively rises until it the latter is completely filled.

At this point, load injection is stopped and diverted to a second empty reactor.

This initial, coke-depositing stage is followed by a second stage in which the coke produced is recuperated.

To this end, once the reactor has been cleared of any residual hydrocarbons and has been cooled, it is opened at the top and at the bottom and a hole is excavated by means of the appropriate tools. The latter are usually carried by a scaffolding structure or a derrick which enables excavation within the reactor from above. The scaffolding structure (of which there is one per reactor—there are at least two reactors) is set up above the reactors which, in turn, are placed well above ground level to enable load injection and, more especially, recuperation of the resultant coke, which drops via gravity within the reactor and is then evacuated and transported to a storage area or to the utilizer.

SUMMARY OF THE INVENTION

The object of our invention is a process and a device whereby scaffolding above the reactors can be avoided, thus reducing the bulk of the structure as a whole, diminishing investments and rendering coke extraction more practical and more economical.

The process of evacuating coke from a reactor to be decoked, the latter forming an element of a series of coking reactors placed side by side and having approximately vertical axes, is characterized by the projection of a stream of water under pressure towards the coke by means of a water-ejection system attached to the end of a flexible tube guided by a guide-pulley placed above the reactors, which guide-pulley can be moved sideways to be positioned above each of the reactors alternately, said tube being wound, when not in use, around the hub of a storage drum positioned in the reactors' axial plane and to the side of the series of reactors, said storage drum revolving about its axis thereby enabling the tube to be unwound to a positive above the reactor to be decoked and the ejection system to be lowered or raised within the reactor to be decoked, said tube being reinforced to resist internal pressure and tensile and torque stresses.

Our invention consists in lowering into the reactor, from the storage drum around which it is wound, a flexible tube of determined rigidity, of which the free end (i.e., that which is furthest from the hub of the drum when the tube is wound) is equipped with a downwards- and/or sideways-directed water-ejection device, the lowering of said tube being determined by the rotation of the guide-pulley. The other end of the tube is connected to a source of water under pressure: the water runs through the tube to the ejection device whence it is discharged towards the bed of coke. The lumps of coke that break loose are then removed.

The guide-pulley can be moved sideways to position it above each reactor in turn, the flexible tube then being lowered along the axis of the reactor to be decoked.

Our invention makes use of flexible tubing, the properties of which are such that water under very high pressure can flow therein without incurring any risk. Moreover, said tubing is highly resistant to tensile stress and is of determined rigidity. Tubes made of such tubing can thus carry heavy loads attached to their ends, thereby not only enabling tools (turbine) to be introduced within the reactor but also avoiding tube oscillation when water discharges under very high pressure are used.

The water ejection device is thus attached to the end of the flexible tube and can be progressively lowered to the bottom of the reactor to be decoked by rotation of the storage drum.

The immobile end of the tube, which emerges from the shaft of the storage drum, is connected to a pump which injects water under high pressure.

The operation can be performed in two stages:

the first consists of excavating a hole along the axis of the reactor by introducing, from above, the end of the tube carrying the water-ejection device. Water is ejected at a pressure of from 80 to 600 bars via downward-facing apertures in the lower end of the device. The device employed preferentially is such that it rotates about its axis in the manner of a turbine, the rotation of such turbine being the result of the specific positioning of one or several ejection apertures (one or several jets having an at least partially tangential component).

in the second stage, water is injected laterally, tangentially or perpendicularly according to the device used (fixed nozzle or turbine). Water pressure at from 80 to 600 bars or more, and preferably 100 to 400 bars, causes the deposited coke to disentegrate and withdraw from the reactor base together with the flow of water. The use of water under high pressure, e.g., 100–400 bars or more, procures relatively large lumps of coke and avoids producing fine particles which would be difficult to separate later.

Alternatively, stopping the vertical ejection of water downwards and starting the lateral ejection of water can be remote-controlled by any appropriate device (making use, for instance, of remote-control conductors incorporated in the flexible tube), thereby obviating raising the tube.

The guide-pulley can be mobile; it can move, for instance, on rails and thus be positioned above the reactor to be decoked while the other reactors are either in operation or awaiting decoking.

Such flexible tubes as can be used in the context of our invention are comprised of superimposed layers which can incorporate one or several watertight plastic sheathings, at least one armature able to withstand internal pressure, said armature consisting, for example, of at least one short-pitch, spiral winding, and at least one armature able to withstand tension and torque, said latter armature consisting, for example, of two long-pitch, crossed windings.

The aforementioned tubes are well within the limits of the following characteristics, determined at a temperature of 20C:

Sufficient flexibility to be wound around a drum of radius 0.5 to 5 meters.

Internal resistance to pressures of at least 80 bars and preferably of 150 to 1000 bars.

Resistance to tensile breakage of $10^4$ to $10^6$ daN and preferably of $2\times10^4$ to $5\times10^5$ daN.

Limit torque: 100 to 10000 m.daN and preferably 500 to 5000 m.daN.

Rigidity: 50 to 1000 daN.m$^2$ and preferably 100 to 500 daN.m$^2$.

Operation is preferred with a weight attached to the end of the tube (ejector +possible additional weighting) of $10^3$to $5\times10^4$ daN; such weighting must, of course, be compatible with the tensile resistance of said tube.

Tubes with characteristics such as the abovementioned have been studied by the Institut Francais U Petrole and are at present sold by Societe Coflexip, France.

BRIEF DESCRIPTION OF THE DRAWINGS

FIGS. 1 and 2 illustrate the application of our invention.

FIG. 1 is an overall side view of the installation.

DESCRIPTION OF THE PREFERRED EMBODIMENT

Figure 1:
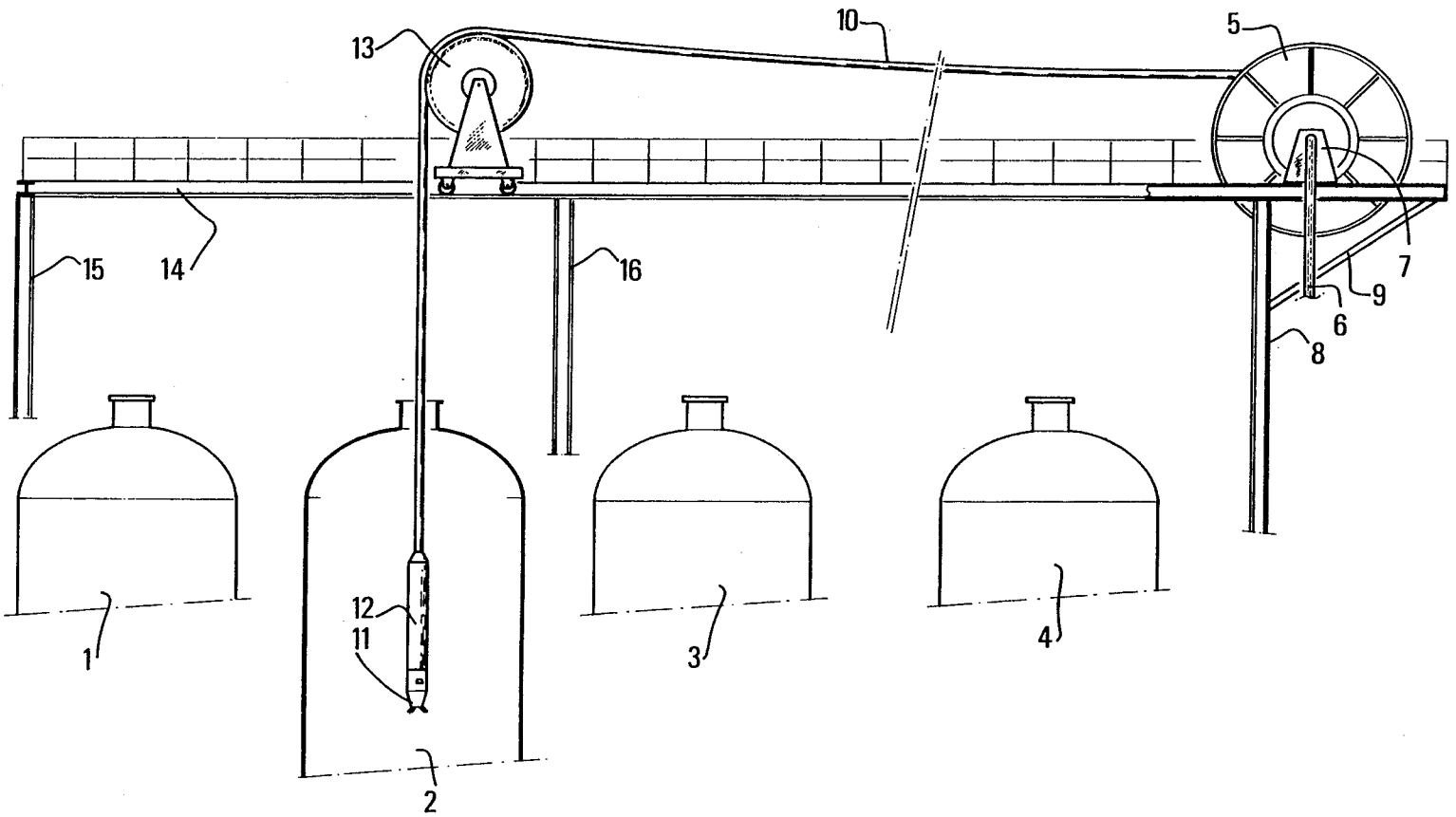
Figure 2A:
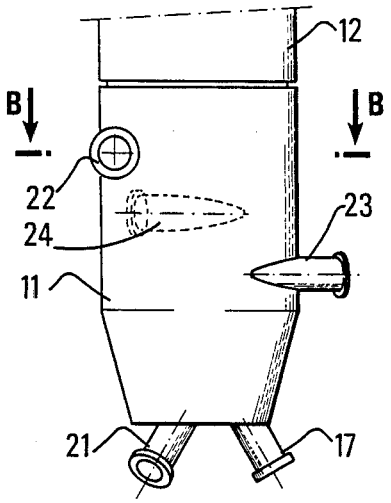
FIGS. 2*a* and 2*b* illustrate ways of setting up the water ejection device, respectively a lateral view and a cross-section BB perpendicular to the axis of nozzle 22.
Figure 2B:
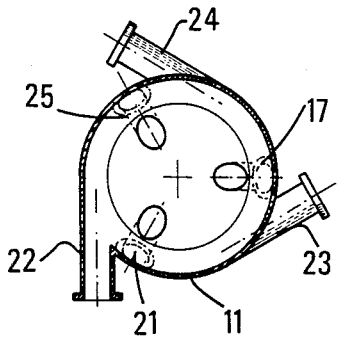

The installation can comprise, for instance, four coking reactors 1 to 4. Reactor 2 is undergoing decoking. With a view to simplification, the hydrocarbon admission and volatile matter evacuation pipes have not been shown. A winder or drum 5 is placed at a distance from the reactors. The rotation shaft of said drum is hollow and serves for the supply of water which arrives under pressure via pipe 6 through a swivel joint connecting the drum rotation shaft to said pipe. The drum axle bears on two rigid plates, only one (7) of which is shown. The two said plates are set on a chassis or are carried by a scaffolding or a superstructure such that it comprises joists 8 and 9. A flexible tube of high mechanical resistance 10 is wound on the drum and is connected to pipe 6 by a coupling element (not shown) enabling the supply of water irrespective of the position of the drum. The other end of said tube carries a turbine 11 having the capacity to revolve about its axis under the thrust of jets of water issuing from nozzles such as 22, 23 and 24, the positioning of which can include a tangential component. If the turbine is insufficiently heavy, a relatively heavy additional mass 12 enables the weight borne by the tube to be increased. The flexible tube passes over a guide pulley 13 which keeps it in line with the axis of the reactor, irrespective of the length of tube unwound from the drum. Said pulley can be moved along rails 14 to be positioned above each reactor successively. Said rails are carried by a scaffolding of joists such as 8, 9, 15 and 16. Additional supporting pulleys can be set between storage drum 5 and guide pulley 13 to carry and guide the flexible tube.

Turbine 11 comprises nozzles 17, 21 and 25 positioned to eject downwards and nozzles 22 to 24 positioned to eject laterally with a tangential component to induce turbine rotation. Said turbine is independent of mass 12 which, normally speaking, does not rotate with the turbine (connection between turbine 11 and mass 12 is ensured via bearings and a speed reducer).

Operation can be as follows: with turbine 11 being initially raised above reactor 2, the upper and lower ends of said coke-filled reactor 2 are opened and turbine 11 is lowered by unwinding tube 10, via guide pulley 13, from storage drum 5. The water under pressure discharging through tube 10 is ejected through the lower, downward-pointing nozzles, such as 17 and 21, and the tube is progressively lowered into the reactor as per the excavation of a hole by the jets of water in the bed of coke. When the turbine reaches the lower end of the reactor, the coke is carried out by the flow of water via the lower opening and falls beneath the reactor whence it is evacuated by known means of transport.

Turbine 11 is then raised clear of the reactor, lower turbine nozzles 17, 21 and 25 are closed (except when increased coke washout is required), and side nozzles 22 to 24 are opened. The coke on the sides of the reactor is then loosened and is evacuated by the lower reactor opening.

Once the operation is completed, the turbine is hoisted out of reactor 2, guide pulley 13 and its attendant equipment is moved along rails 14 to reactor 3, into which, after it has been opened, the tube and turbine are lowered to start decoking said reactor 3. Meanwhile, reactor 2 can again be put to use for a further coking operation.

Instead of a single turbine 11 with downwards- and sideways-facing apertures, two separate turbines can be employed successively, one with downwards-facing apertures and the other with sideways-facing apertures.

We claim as our invention:

1. A decoking process for the removal of coke from one coke reactor at a time of a series of coke reactors, the reactors having mouths opening in the same axial direction, the process comprising:

projecting water under pressure against the coke in one of the reactors by discharging the water from a water ejection device suspended on a flexible tube supported above the one coke reactor on a guide pulley movably mounted above the series of reactors;

lowering and raising the water injection device to translate the device in the one coke reactor by rotating a drum around which the tube is wound, the drum being fixedly positioned laterally of the series of coke reactors with the tube extending from the drum and over the pulley, and moving the tube from the one coke reactor to a second coke reactor of the series of coke reactors by raising the water ejection device by rotating the drum to remove the water ejection device from the one coke reactor and then moving the pulley to align the water ejection device with the second coke reactor.

2. The decoking process of claim 1 further including the step of rotating the water ejection device as the water ejection device projects water and translates in the coke reactors.

3. The process according to claim 1, wherein said tube comprises a flexible pipe having an internal compressive strength of at least 100 bars, a rigidity at 20° C.

of 50–1,000 daN.m$^2$, an ultimate elongation strength of $10^4$–$10^6$ daN, a limit twisting moment of $10^2$–$10^4$ m.daN and has sufficient flexibility to allow repeated windings of the flexible pipe at a radius of 0.5–5 meters.

4. The process of claim 1, wherein the flexible tube has a resistance to internal pressure of at least 80 bars at 20° C. and is of sufficient flexibility to enable successive winding onto and unwinding from the storage drum, the storage drum having a radius of from 0.5 to 5 meters.

5. The process of claim 4, said flexible tube having, at 20° C., a rigidity of 50 to 1000 daN.m$^2$, a resistance to tensile breakage of $10^4$ to $10^6$ daN and a torque limit of $10^2$ to $10^4$ m.daN.

6. The process of claim 5, said flexible tube having, at 20° C., a resistance to internal pressure of 150 to 1000 bars, a resistance to tensile breakage of $2\times10^4$ to $5\times10^5$ daN, a torque limit of 500 to 5000 m.daN and a rigidity of 100 to 500 daN.m$^2$.

7. The process of claim 1, wherein the pressure of the water ejected is in the range of 100 to 400 bars.

8. The process of claim 1, wherein the ejection device has a weight in the range of $10^3$ to $5\times10^4$ daN.

9. A decoking apparatus in combination with a plurality of coking reactors said decoking apparatus comprising a flexible tube, at least one flexible-tube storage drum around which the flexible tube is wound, the storage drum having an axis about which the storage drum is rotatable for winding and unwinding the flexible tube and being fixedly positioned laterally in relation to the plurality reactors, at least one guide pulley over which the flexible tube is draped, and means for movably mounting the guide pulley above the coking reactors for translation between the reactors to a position above each reactor of said reactors in turn said flexible tube having a first end connected to an immobile liquid supply means and a second end connected to a device ejecting liquid for impinging on and disloding coke in the coking reactors.

* * * * *